US005741399A

United States Patent [19]

Antkowiak

[11] Patent Number: 5,741,399

[45] Date of Patent: Apr. 21, 1998

[54] PULP WASHING METHOD

[75] Inventor: John S. Antkowiak, Francestown, N.H.

[73] Assignee: Beloit Technologies, Inc., Wilmington, Del.

[21] Appl. No.: 669,678

[22] Filed: Jun. 24, 1996

[51] Int. Cl.[6] ..... D21C 9/02

[52] U.S. Cl. ..... 162/43; 162/60; 8/156

[58] Field of Search ..... 162/41, 43, 60; 210/386, 387, 402; 8/156

[56] References Cited

U.S. PATENT DOCUMENTS

| | | | |
|---|---|---|---|
| 2,057,059 | 10/1936 | Rue | 92/1 |
| 2,988,470 | 6/1961 | Bradway et al. | 162/17 |
| 3,959,068 | 5/1976 | McIlroy et al. | 162/17 |
| 4,039,372 | 8/1977 | Reeve et al. | 162/19 |
| 4,273,612 | 6/1981 | Hillstrom et al. | 162/49 |
| 4,292,123 | 9/1981 | Lintunen et al. | 162/60 |
| 4,472,242 | 9/1984 | Osawa et al. | 162/60 |
| 4,806,203 | 2/1989 | Elton | 162/19 |
| 5,046,338 | 9/1991 | Luthi | 68/43 |
| 5,116,423 | 5/1992 | Kokkonen et al. | 134/15 |

FOREIGN PATENT DOCUMENTS

| | | |
|---|---|---|
| 0 239 312 A1 | 3/1987 | European Pat. Off. . |
| WO 92/22702 | 12/1992 | WIPO . |
| WO 97/10379 | 3/1997 | WIPO . |

OTHER PUBLICATIONS

A Beloit Belpond Washer Operation Manual, 1992.

Kamyr Wash Press Bulletin, 1986.

1993 Tappi Pulping Conference Proceedings, A Mathematical Model of Fractional Pulp Washing and Applications In a Bleaching Plant pp. 151–154.

*Primary Examiner*—Donald E. Czaja
*Assistant Examiner*—Steven B. Leavitt
*Attorney, Agent, or Firm*—Dirk J. Veneman; Raymond W. Campbell; Paul F. Donovan

[57] ABSTRACT

In a pulp washing method which employs a dilution stage, followed by an extraction stage, and followed, in turn by a dilution stage, filtrates from the extraction stage and the displacement stage are segregated so that at least a part of the filtrate from the extraction stage may be removed from the pulp washing.

5 Claims, 3 Drawing Sheets

PULP WASHING METHOD

FIELD OF THE INVENTION

This invention relates to a method of washing pulp utilized in the manufacture of paper.

BACKGROUND AND OBJECTS OF THE INVENTION

To provide for the removal of undesirable substances, such as digesting chemicals, from the pulp feed stock used in the manufacture of paper, it is common to subject the pulp feed stock to at least one, but typically several successive, stage(s) of "washing" to remove the undesirable impurities. It is now also common in the industry to use within each washing "stage" several successive "steps" which involve distinctly separate processes. Also common as part of a washing stage is the dilution of the pulp feed stock for ease of transport prior to, or between the various one or more "washing" stages, and for proper mat formation since each washing stage removes some liquids and increases the consistency of the resulting pulp.

In greater detail, the washing is accompanied by both the supply, and extraction, of liquids, known in the former instance as a displacement liquor, and in the latter instance, as a filtrate. In addition, "liquor" is normally added in the dilution step to liquify the pulp and thereby facilitate its transport to a subsequent processing station and for the desired mat formation. Displacement liquor (which may be either pure water, or more commonly, a filtrate extracted from a succeeding washing stage or step), is a liquid added to the washing stage to "displace" the liquid in the pulp containing the contaminants to be removed. Filtrates which contain the undesirable impurities, are removed in each washing stage.

Typically, the prior art has configured, whether by drums or belts, the pulp flow moves as one in which the liquids, part of which were added in the dilution step, are extracted in an extraction step by mechanical means, such as converging passages, and/or pressure differentials. In this step, no displacement liquor is added and the extraction of liquids containing impurities, in the form of a filtrate, is achieved by purely mechanical action.

The (mechanical) extraction step is generally followed by a "displacement" step wherein a liquid (called a liquor if it contains any impurities at all, or fresh water if it contains none) is added to the washing stage to thereby force out another filtrate, also containing impurities, but in a lesser amount than the filtrate from the extraction step. The several filtrates, i.e. the extraction step filtrate and the displacement step filtrate are then combined and either partially or wholly provided to the dilution phase of the particular washing stage being fed. By combining the filtrates from both the extraction and the displacement step, the dirtier filtrate from the extraction step contaminates the cleaner filtrate from the displacement step and thereby results in an undesirable recirculation of impurities in the washing process.

While the segregation of filtrates in a pulp washer is not unknown, the prior art has limited the application of such segregation to only between the several displacement steps of a multi-phase washer and not, as proposed by this invention, between the extraction and displacement steps. Segregation of filtrates between the extraction and displacement steps of a pulp washer leads to a considerable reduction in the total wash flow of a pulp washer, compared to a displacement step segregated multi-phase washer.

Accordingly, it is a primary object of this invention to decrease the undesirable recirculation of contaminants removed by filtrates from the washing process of a pulp.

SUMMARY OF THE INVENTION

In accordance with the invention, the several filtrates commonly existing within one washing stage of a washing process typically comprising several washing steps, are segregated and the dirtier filtrate, from the extraction step, is not substantially thereafter utilized in either the dilution or the displacement process. The cleaner filtrate, resulting from the displacement step in a washing stage, is utilized only for dilution of the pulp feed (or perhaps, as a "displacement" liquor for a preceding stage within a multi-stage washer). The most dirty filtrate (from the extraction step) is substantially or completely "directed" out of the washing stage to a step for the evaporation of the liquor and the recovery of the chemicals, or for use as displacement liquor for a preceding wash stage.

The foregoing and other features, advantages, and aspects of the invention are further described with reference to a preferred embodiment as illustrated in the accompanying drawings.

THE DRAWINGS

DETAILED DESCRIPTION

Figure 1:
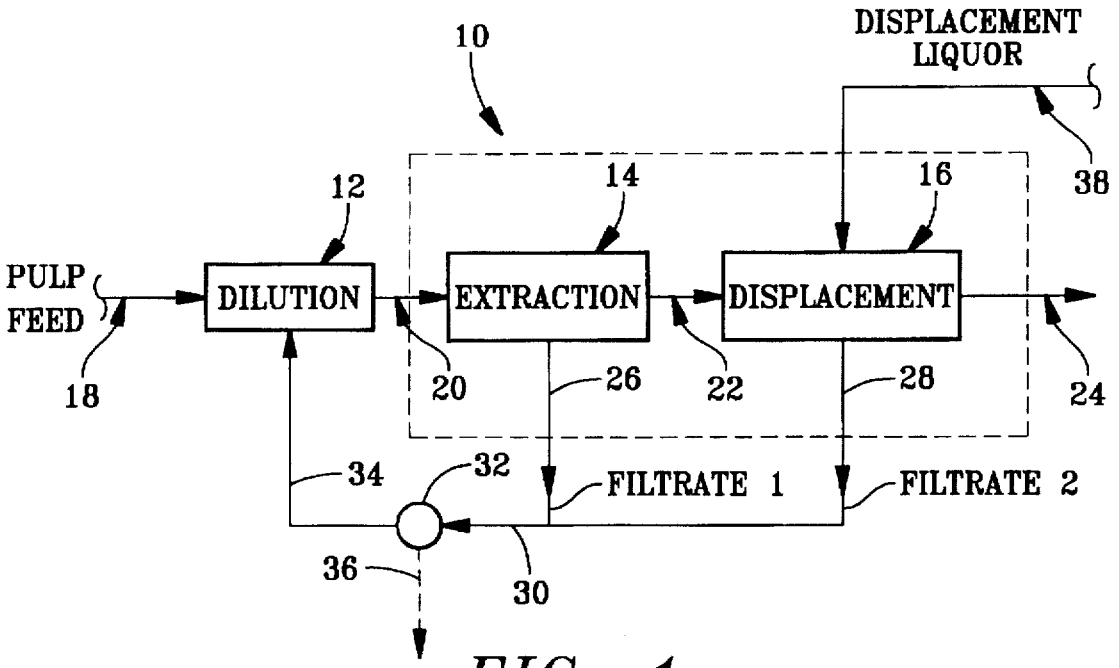
FIG. 1 (PRIOR ART)
FIG. 1 shows a typical prior art single stage washing apparatus in a schematic flow diagram.

FIG. 1 shows a single washing stage 10 of the prior art in which a dilution step 12 is followed by an extraction step 14 and a displacement step 16 in which a pulp feed, supplied by an otherwise common transport pipeline 18, is thereafter provided, by transport lines 20 and 22, to an extraction step 14 and a displacement step 16. After the displacement step 16, the pulp is fed, via transport line 24, to either a succeeding washing stage or for a subsequent processing of a different kind.

In extraction step 14, a filtrate (filtrate 1) is removed by conventional and known mechanical means. This filtrate is removed via a hydraulic circuit 26. The filtrate (filtrate 2) removed from the displacement phase 16 of washer 10 is removed by way of a hydraulic circuit 28. Both filtrates, i.e. filtrate 1 and filtrate 2, are then combined in a common hydraulic circuit 30 from whence the total combination is, either partially or wholly, as adjusted by a splitting valve 32, provided to the dilution phase 12 of a particular washing stage 10, by way of a hydraulic circuit 34. Any part of the filtrate in circuit 30 not provided to circuit 34 is removed from the washing stage by way of a hydraulic circuit 36.

It is well known that the filtrate extracted from the extraction phase 14 (filtrate 1) contains significantly more impurities than the filtrate (filtrate 2) removed from the displacement phase 16 as a result of the displacement liquor added to the displacement phase 16 by way of a hydraulic circuit 38. Thus, the combination of filtrates 1 and 2 results in a filtrate contamination of the filtrate provided to the dilution phase 12 by way of a hydraulic circuit 34. It is an object of the invention to minimize, or completely avoid if possible, such an undesirable combination and consequent recirculation of contaminants which are to be removed from the pulp feed stock.

Figure 2:
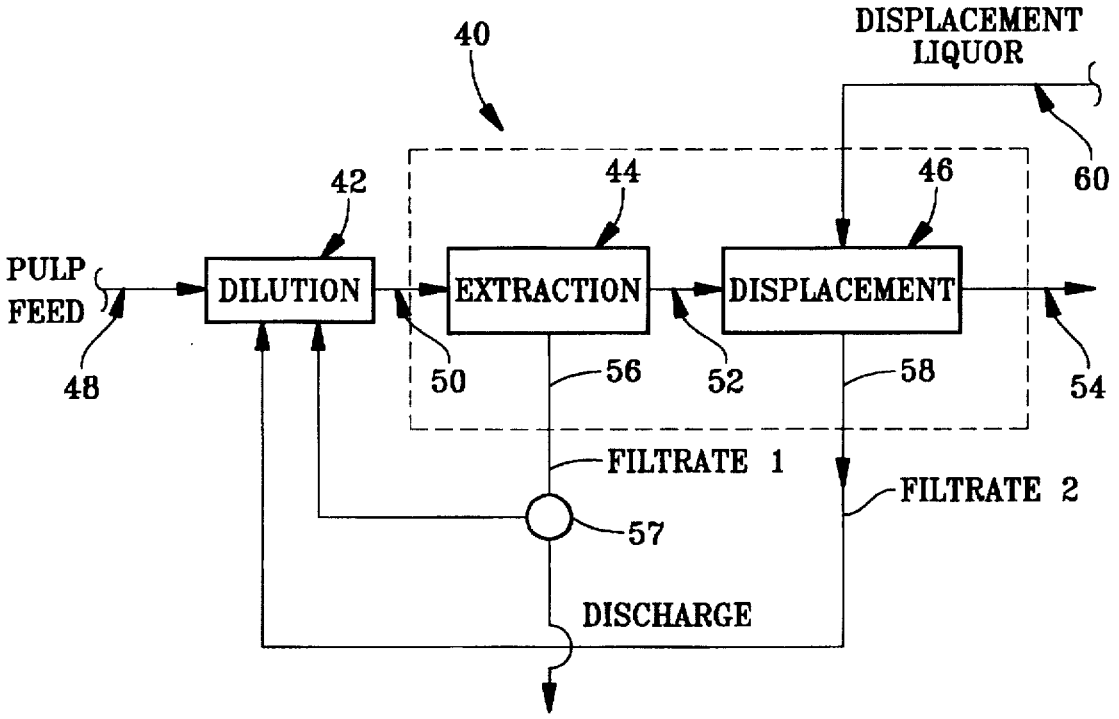
FIG. 2 illustrates the schematic flow diagram of a single stage washer in accordance with the invention.

FIG. 2 illustrates a single washing stage 40 which again, as in the prior art, comprises a dilution step 42, an extraction step 44, and a displacement step 46. The pulp is fed by a hydraulic circuit 48 to the dilution phase 42 while subsequent hydraulic transport circuits 50 and 52 supply the pulp to the extraction step 44, and the displacement step 46. After the displacement step 46, a hydraulic transport circuit 54 transports the pulp emanating from single washing stage 40 to a subsequent washing stage, or if the washing is deemed completed, to a subsequent processing stage.

The filtrate 1, removed from the extraction step 44 (by conventional and known means) is isolated and segregated in a separate hydraulic circuit 56 and a substantial part thereof is directed away from the washing process thereafter and not further utilized in the washing stage in accordance with the invention. A proportioning valve 57 allows only that minimum of filtrate 1 to stay in the washing process as may be needed for the dilution step. It may be zero in some washing methods and it may be as much between 50% to 70%. The filtrate (filtrate 2) removed from the displacement step 46, by way of a hydraulic circuit 58, is then provided to the dilution phase 42 of that particular washing stage 40. It is to be noted that filtrate 2, from displacement step 46, is kept separate from the filtrate 1 coming out of the extraction step 44 and that most of the filtrate 1 is not thereafter utilized in any part of the washing stage. This filtrate 1 has a significantly higher concentration of undesirable chemicals than filtrate 2 and therefore, if all furnished back to the dilution phase 42, as in the prior art, would significantly increase the "contaminant" concentration in the washing process. It is to be noted that in other respects, washing stage 40 operates in an otherwise conventional manner in which a displacement liquor (which may be pure water in the latter portions of a washing system) is used to create a filtrate 2 from displacement step 46 of a washing stage 40 in accordance with the invention. For further details as to how a multi-step washer operates and how filtrates are segregated, reference may be had to U.S. Pat. No. 5,046,338, assigned to the same assignee as of this application, the disclosure of which is incorporated herein by this reference.

Figure 3:
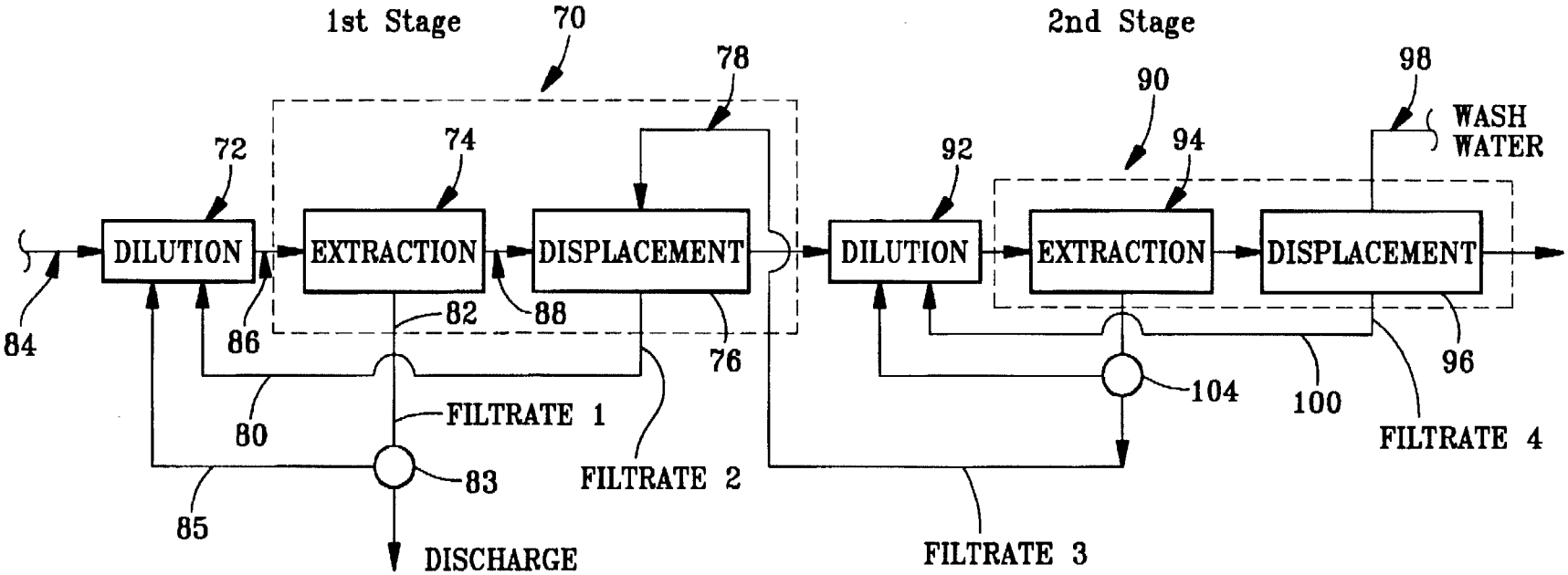
FIG. 3 illustrates the schematic flow diagram of a multiple stage washer washing system in accordance with the invention.

FIG. 3 shows a two-stage washing system in which a first stage 70 is followed by a second stage 90.

In the first stage 70, a dilution step 72 is followed by an extraction step 74 which provides a pulp feed to a displacement step 76. Displacement liquor provided to the displacement step 76 by a hydraulic circuit 78 results in a filtrate on hydraulic circuit 80, filtrate 2, which is provided to the dilution step 72. The filtrate from extraction step 74, filtrate 1, is provided, by way of a separate hydraulic circuit 82, separate from hydraulic circuit 80, to a proportioning valve 83 where a substantial portion of the filtrate 1 is channelled so to not re-enter the washing stage 1. The remainder is provided to the dilution step by way of circuit 85.

In an otherwise conventional flow, the pulp flows by transport circuits 84, 86 and 88 within the first washing stage to the second washing stage 90 wherein, again, a dilution step 92 is followed by an extraction step 94 and a displacement step 96. Again, in second stage 90 a displacement liquor, or fresh water at this point, is supplied by way of a hydraulic circuit 98 so that the filtrate, filtrate 4, removed from displacement step 96 is provided to the dilution step 92 by way of a separate hydraulic circuit 100. The filtrate 4 removed from displacement phase 96 is, again, "cleaner", i.e. having a lower concentration of undesirable constituents, than the filtrate removed from the extraction step 94. As in stage 1, a substantial portion of the extraction filtrate, filtrate 3, is provided, by Way of a proportioning valve 104, to displacement step 76 of the preceding washing stage by way of hydraulic circuit 78 whence it does not re-enter the second washing stage 90.

Figure 4:
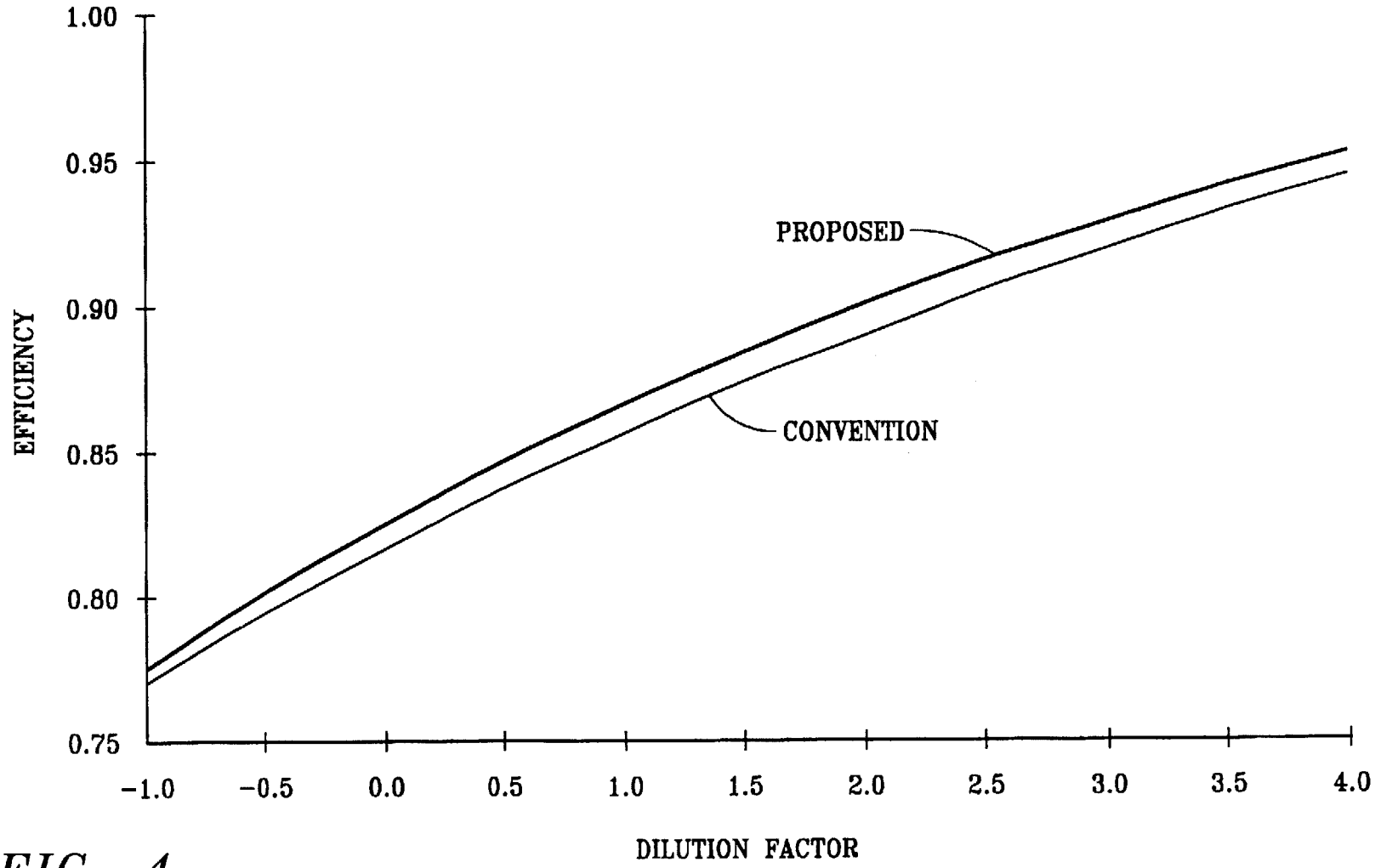
FIG. 4 is a graph showing the washing efficiency of the present invention in comparison to conventional washing efficiency.

FIG. 4 illustrates the increased efficiency, as compared to a conventional prior art system, of the invention of a hypothetical one stage washing system containing 0% dissolved solids, unwashed stock with a fresh water liquor. In this case, efficiency is defined as $$1-\frac{\text{contaminants out}}{\text{contaminants in}}.$$

While the invention has been particularly shown and described with reference to preferred embodiments thereof, it will be understood by those skilled in the art that the foregoing and other changes in form and detail may be made therein without departing from the spirit and scope of the invention as defined in the claims attached hereto.

I claim:

1. A process for washing pulp which includes a dilution step, an extraction step and a subsequent displacement step, the improvement comprising:

diluting the pulp;

passing the diluted pulp to the extraction step;

developing a first filtrate from the extraction step;

passing the pulp from the extraction step to the displacement step;

developing a second filtrate from the displacement step;

segregating the first and second filtrates from each other;

providing the second flitrate to the dilution step;

providing a determined minimum volume of the first flitrate needed for the dilution step; and eliminating the remaining volume of the first flitrate from further use in the washing of pulp.

2. In a multiple stage, multiple step pulp washing system, wherein each washing stage is preceded by a dilution step and thereafter followed by an extraction step preceding a displacement step, the process improvement comprising:

diluting the pulp;

passing the diluted pulp to an extraction step of a first stage;

development of a first filtrate from the extraction step of the first stage;

passing the pulp from the extraction step of the first stage to the displacement step of the first stage;

development of a second filtrate from the displacement step of the first stage;

segregating the first and second filtrates from one another;

providing the second filtrate of the first stage to the dilution step of the first stage.

providing a determined minimum volume of the first filtrate from the extraction step of the first stage needed for the dilution step of the first stage; and discarding substantially all of the first flitrate from the first stage.

3. A process according to claim 2 further characterized in that a second filtrate of another stage is provided to a dilution step of that stage.

4. A process according to claim 3 further characterized in that a first filtrate of another stage is provided substantially entirely to the displacement step of a preceding stage.

5. A process according to claim 4 further characterized in that a determined minimum volume of the first flitrate of the other stage is provided to the dilution step of that stage as needed.

* * * * *

UNITED STATES PATENT AND TRADEMARK OFFICE

CERTIFICATE OF CORRECTION

PATENT NO. : 5,741,399

DATED : Apr. 21, 1998

INVENTOR(S) : John Antkowiak

It is certified that error appears in the above-indentified patent and that said Letters Patent is hereby corrected as shown below:

Column 4, lines 28, 30, 31, 54 & 63:

"flitrate" should read --filtrate--.

Signed and Sealed this

Eleventh Day of August 1998

Bruce Lehman

*Attest:*

BRUCE LEHMAN

*Attesting Officer*

*Commissioner of Patents and Trademarks*